US009945166B2

(12) United States Patent
Rihtarec et al.

(10) Patent No.: US 9,945,166 B2
(45) Date of Patent: Apr. 17, 2018

(54) DEVICE FOR MOVING A MOVABLE FURNITURE PART, AND ITEM OF FURNITURE

(71) Applicant: Grass GmbH, Hoechst (AT)

(72) Inventors: Filip Rihtarec, Fussach (AT); Markus Albrecht, Lustenau (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 15/238,006

(22) Filed: Aug. 16, 2016

(65) Prior Publication Data

US 2017/0049232 A1 Feb. 23, 2017

(30) Foreign Application Priority Data

Aug. 21, 2015 (DE) ..... 20 2015 104 438 U

(51) Int. Cl.
*A47B 88/04* (2006.01)
*E05F 1/16* (2006.01)
(Continued)

(52) U.S. Cl.
CPC ..... *E05F 1/16* (2013.01); *A47B 88/0477* (2013.01); *A47B 88/463* (2017.01); *A47B 2210/0056* (2013.01); *E05F 5/003* (2013.01); *E05Y 2201/426* (2013.01); *E05Y 2201/624* (2013.01); *E05Y 2600/12* (2013.01); *E05Y 2900/20* (2013.01)

(58) Field of Classification Search
CPC ..... A47B 88/46; A47B 88/47; A47B 88/463; A47B 88/467; A47B 88/0477; E05F 1/16; E05F 15/00
USPC ..... 312/319.1, 330.1, 334.1, 334.4
See application file for complete search history.

(56) References Cited

U.S. PATENT DOCUMENTS 9,622,578 B2 * 4/2017 Goetz ..... A47B 88/57
2003/0117048 A1 6/2003 Mueller
(Continued)

FOREIGN PATENT DOCUMENTS

AT 508 139 A4 11/2010
AT 514065 * 10/2014
(Continued)

OTHER PUBLICATIONS

Extended European Search Report (Application No. 16181470.2) dated Jan. 23, 2017.
(Continued)

*Primary Examiner* — James O Hansen
(74) *Attorney, Agent, or Firm* — Burr & Brown, PLLC

(57) ABSTRACT

A device for moving a movable furniture part, the device including a basic component on which a force accumulator is present such that the movable furniture part under the action of the force accumulator is capable of being put in the opening direction of the movable furniture part. A separate cover component, configured so as to match the basic component, of the device is present, which cover component covers the basic component, wherein connection means on the cover component are configured in such a manner that integration of the device on a counter portion on the item of furniture and/or the guide means is arrangeable using the connection means which are present on the cover component.

12 Claims, 10 Drawing Sheets

(51) Int. Cl.
*A47B 88/463* (2017.01)
*E05F 5/00* (2017.01)

(56) References Cited

U.S. PATENT DOCUMENTS

| | | | | |
|---|---|---|---|---|
| 2014/0300262 | A1 | 10/2014 | Flogaus | |
| 2015/0374125 | A1* | 12/2015 | Goetz ..... | A47B 88/0477 312/319.1 |

FOREIGN PATENT DOCUMENTS

| | | | |
|---|---|---|---|
| CA | 2 819 278 | A1 | 6/2012 |
| DE | 101 57 754 | A1 | 6/2003 |
| DE | 20 2005 004 336 | U1 | 6/2005 |
| DE | 10 2010 036 903 | A1 | 9/2011 |
| DE | 10 2010 061 160 | A1 | 6/2012 |
| DE | 21 2012 000 231 | U1 | 9/2014 |
| WO | WO 2015/058222 | A1 * | 4/2015 |

OTHER PUBLICATIONS

German Search Report (Application No. 20 2015 104 438.0) dated Jun. 3, 2016.

* cited by examiner

DEVICE FOR MOVING A MOVABLE FURNITURE PART, AND ITEM OF FURNITURE

This application claims the benefit under 35 USC § 119(a)-(d) of German Application No. 20 2015 104 438.0 filed Aug. 21, 2015, the entirety of which is incorporated herein by reference.

FIELD OF THE INVENTION

The present invention relates to a device for moving a movable furniture part, and an item of furniture.

BACKGROUND OF THE INVENTION

In the case of furniture parts such as, for example, drawers, furniture doors, or furniture flaps which are movably received on a basic furniture structure of an item of furniture by way of guide means, devices for influencing the movement of the furniture part are employed. Devices of this type are formed by a unit which is attachable to the furniture part or to the basic furniture structure or the guide means at a suitable point, for example.

In particular, the guide means comprise a sliding guide such as a full pullout or a part pullout, or a pivoting guide such as a furniture hinge.

In the case of modern and user-friendly items of furniture, devices for moving the furniture part are known, which may optionally be provided for making available an additional function, for example, in particular, in order to facilitate a user in opening the furniture part. The additional function is, in particular, adaptable to the type and size of the furniture part. The device for influencing the movement of the furniture part relates to systems for providing a force-assisted opening function for the furniture part, for example. Herein, the type of integration of the device has to be considered in each case.

SUMMARY OF THE INVENTION

It is an object of the present invention to provide in an advantageously or flexibly disposable manner an additional function for movement of the furniture part or a corresponding item of furniture by means of a sliding guide, such as a full pullout or part pullout, or of a pivoting guide, in particular, so as to enable a force assistance of an opening movement for opening the furniture part on a first partial distance of the opening path.

The present invention proceeds from a device for moving a movable furniture part in an opening direction of the furniture part in relation to a basic furniture structure of an item of furniture, wherein the movable furniture part by way of guide means is capable of being put in the opening direction and in a closing direction which is counter to the opening direction, wherein the device comprises a basic component on which a force accumulator is present such that by way of the fitted device the movable furniture part under the action of the force accumulator is capable of being put in the opening direction of the movable furniture part.

The core concept of the present invention lies in that a separate cover component, configured so as to match the basic component, of the device is present, which cover component covers the basic component, wherein connection means on the cover component are configured in such a manner that integration of the device on a counter portion on the item of furniture and/or the guide means is arrangeable using the connection means which are present on the cover component. Advantageous, space-saving and easy-to-fit integration of the device may thus be implemented. In particular, the cover component is connectable as a separate element to the basic component. The cover component is connected to the basic component in a releasable or non-releasable manner, in particular, plug-fitted to the basic component in a non-releasable manner.

Proceeding from a universally usable basic component, dissimilar variants of a cover component for integration on various counter portions such as, for example, guide means with are in each case dissimilar, may be provided. Therefore, by means of the respective cover part which matches the guide means used, precisely one embodiment of the basic component is sufficient in order for the device to be integrated on dissimilar variants of guide means, for example. Upon completion of the device, and proceeding from the basic component, only the respective variant of the cover component has to be selected and connected to the basic component.

Each variant of the cover component matches the basic component such that the assembly of the basic component and of the selected matching cover component is advantageously performed in the same manner. The individual connection portions on the respective cover component differ in the case of the individual variants of the cover components. The dissimilarities are preferably present only in the connection means on the cover component.

The fundamental functions of the device are implemented on the basic component. Moreover, the cover component covers the basic component at least on one side, protection against contamination of and/or damage to the device thus being implemented by the cover component.

For example, a unilateral planar and at least partial peripheral cover of, in particular, an internal region of the device is performed by way of the cover component. The other planar side of the device is closed off by way of a wall of the basic component, or is closed off toward the outside by way of a planer side of the basic component, respectively.

By way of a comparatively narrow height of the device, portions of the cover component, and/or portions of the basic component may optionally in an overlapping manner form the external side of the device. In particular, these portions are formed to be at a right angle to a main face side of the basic component or of the cover component, respectively.

In particular, the cover component is formed from a flat sheet-metal component by way of clearances and bent-back features. Alternatively, the cover component is from a plastics material.

The device is preferably configured as an ejector unit having a force accumulator which is chargeable in the case of a closing movement of the furniture part. The charged or tensioned force accumulator, respectively, by way of an activation procedure is released from a locked position such that the furniture part under the action of the force which is provided by the force accumulator is moved from the closed arrangement on the basic furniture structure somewhat in the opening direction. Preferably, an activator unit having a touch-latch function, an ejector assembly, a locking mechanism of the tensioned force accumulator, and a charging mechanism for the force accumulator are present on the device or on the basic component, respectively.

It is further advantageous for the cover component to have a planar portion which extends across a substantial extent of the cover component. The planar portion extends across an area which, in particular, is designed to be level. In particular, the planar portion forms an external side of the device which is opposite an external side which is formed by the basic component. In particular, the cover component is integrally formed from a material, in particular, is formed from a sheet-metal panel.

The cover component is comparatively thin, having a preferably uniform wall thickness of one to two millimeters, for example. Cutouts, openings, slots, webs, and/or bent-back features are present on predefined points on the cover component, for example, within a border and/or on the peripheral profile.

It is also of advantage that the cover component has a bearing side which is configured for bearing in a planar manner on an attachment face of the item of furniture when the device is fitted to the item of furniture. In particular, the attachment face of the item of furniture is flat and level. The bearing side is preferably part of the area portion of the cover component. The device which is assembled from the basic component and from the cover component may be advantageously disposed on the item of furniture, or on a planar counter side on the item of furniture or of the furniture part, respectively. For example, the device may be attached by way of the bearing side so as to bear on a level, flat lower side of a drawer base.

According to one advantageous variant of the present invention, the cover component is designed for at least almost completely covering a main side of the basic component. An open side, or the interior of the basic component is thus closed off in relation to the outside, or is protected therefrom, respectively.

It is moreover of advantage that the cover component has a peripheral portion which by way of a bent-back feature adjoins a planar portion of the cover component. In particular, the bent-back feature on the cover component is present so as to be at a right-angle to an adjacent area portion. Preferably, a plurality of peripheral portions of dissimilar design which adjoin the area portion are possible. Peripheral portions which are bent back twice or multiple times, in particular, so as to each be bent back in a rectangular manner, are also conceivable. All bent-back features on the bearing side preferably project in the same direction such that the bearing side of the cover component is formed without elevations or protrusions, respectively.

The basic component, or the peripheral portion thereof, respectively, is adapted to the peripheral portion of the cover component in such a manner that in the assembled state of the device the peripheral portions are mutually complementary such that the device has a predefined peripheral profile, in particular, is largely or completely accommodated or externally closed off, respectively, within the peripheral profile of the basic component.

The peripheral portion of the cover component and/or of the basic component has a peripheral profile which is configurable in various ways, for example, with or without a bent-back feature, straight or contoured, bent in a convex or concave manner, or the like.

One advantageous modification of the present invention is distinguished in that narrow sides of the basic component are covered by a bent-back peripheral portion of the cover component. In this way, narrow sides of the basic component which is covered by the cover component may be protected from dirt or moisture, respectively, by way of a height-related dimension of the basic component, for example.

According to one further variation of the present invention, the cover component has a peripheral portion having an outwardly projecting contour which in relation to adjacent peripheral portions. Preferably, the connection means comprise the peripheral portion having the projecting contour. The projecting peripheral portion serves for connecting the device to counter portions of guide means, in particular. The respective peripheral portions are designed so as to be adapted to counter portions which are present in a matching manner. The shape or contour of the projecting peripheral portion is in the manner of a lug, a strip, and/or a tongue, for example. The peripheral portion having the outwardly projecting contour preferably has external sides which are mutually aligned in an angular manner. In the connected state, the peripheral portions having the outwardly projecting contour are clamped, latched and/or clip-fitted to the associated counter portion on the guide means and/or on the item of furniture. Preferably, the connection means have claw means or hook means for claw-fitting or hook-fitting, respectively, to a resilient material such as a wooden material of the item of furniture or of the basic furniture structure.

One advantageous modification of the present invention is characterized in that the connection means on the cover component are configured in such a manner that integration of the device on a counter portion on the item of furniture and/or the guide means is establishable without tools. This is advantageous for fitting the device.

One advantageous configuration of the present invention is formed in that the cover component and the basic component are mutually adapted in such a manner that in the connected state of the cover component and of the basic component a portion of the basic component outwardly projects on one narrow side of the device. In particular, the basic component and the cover component are configured by a correlating clearance on a common peripheral portion. An operating portion of an adjustment assembly of the device may preferably protrude from the narrow side of the device in the region of the formed gap. The operating portion is thus reachable from the outside by a person, so as to manually act on the device. A bias of the force accumulator may be fixedly adjusted in this way, for example, this being performed depending on the mass of the furniture part to be moved.

Moreover, it is of advantage that the connection means are configured for a releasable connection to the guide means of the movable furniture part. Here, in particular, a connection to a fixed rail or to a basic-structure rail of a full pullout, for example, a plug-fit connection to the basic-structure rail, is to be considered. The connection means are preferably designed such that a high supporting effect of the device on the guide means is possible.

Moreover, it is also of advantage that the cover component is configured for attaching the device on a lower side of a drawer. Preferably, in addition to the attachment to the lower drawer side, attaching the device to a side wall of the drawer, for example, to a decorative feature of a hollow-section frame of the drawer, is also performed.

It is also of advantage that the cover component is configured for integration of the device in the region of a region configured so as to be depressed on the item of furniture. This enables particularly place-saving attachment on a furniture part or on the basic furniture structure. In the fitted state, the cover component by way of an external side preferably bears on the base of the depressed clearance. A corresponding part by way of a step of the cover component preferably reaches out of the depression at the periphery of the clearance, in order for the device to be attached to the guide means, such as a fixed rail of the guide means, and/or to parts of the furniture part, for example, on a side wall of the drawer.

Typically, a wall thickness of the furniture part is greater than a height of the device, such that a residual thickness of the wall remains, forming a base of the depression. The region which is configured in a depressed manner is preferably adapted to the height of the device such that the device is capable of being incorporated or sunk, respectively, in particular, in a complete or flush manner, respectively, in the depressed region, for example, on a lower side of a drawer base. Alternatively, the device may be accommodated in the depression so as to have a slight protrusion in relation to the wall of the furniture part. For example, the depression is in the shape of a strip and in the manner of a groove or a duct, or is adapted, in particular, to the size and/or shape of the device, respectively.

In the case of a depressed clearance in a lower side of a drawer base, the depression across the width of the clearance is preferably open toward a rear periphery of the drawer base but closed in relation to a lateral longitudinal periphery of the drawer base.

Moreover, the present invention extends to an item of furniture having a basic furniture structure and a movable furniture part which by way of guide means is capable of being put in an opening direction of the furniture part and in a closing direction which is counter to the opening direction relative to the basic furniture structure, wherein a device according to one of the configurations explained above is provided. The advantages which have been explained may thus be implemented on the item of furniture. In particular, the item of furniture is configured having a guide or having guide means according to a full pullout or a part pullout, respectively, wherein an automatic retraction feature for retracting the furniture part in a force-assisted manner to a completely closed position is possible in the full pullout or part pullout.

Synchronization of the so-called touch-latch function is also advantageously provided in the case of two lateral guide units. The furniture part is a drawer, for example, which by way of two full pullouts which are laterally present is received so as to be displaceable on the mutually opposite basic-structure walls of the basic furniture structure.

If and when a depression for inserting the device is present on the lower side in a drawer base, that part of the depression that is not occupied by the device is preferably covered by a respective cover element which is level with the lower side of the drawer base. Alternatively, an extension in length on the cover component may cover the remainder of the depression.

BRIEF DESCRIPTION OF THE DRAWINGS

Further features and advantages of the present invention are explained in more detail by means of exemplary embodiments which are schematically illustrated in the figures.

DETAILED DESCRIPTION OF THE INVENTION

Figure 1:
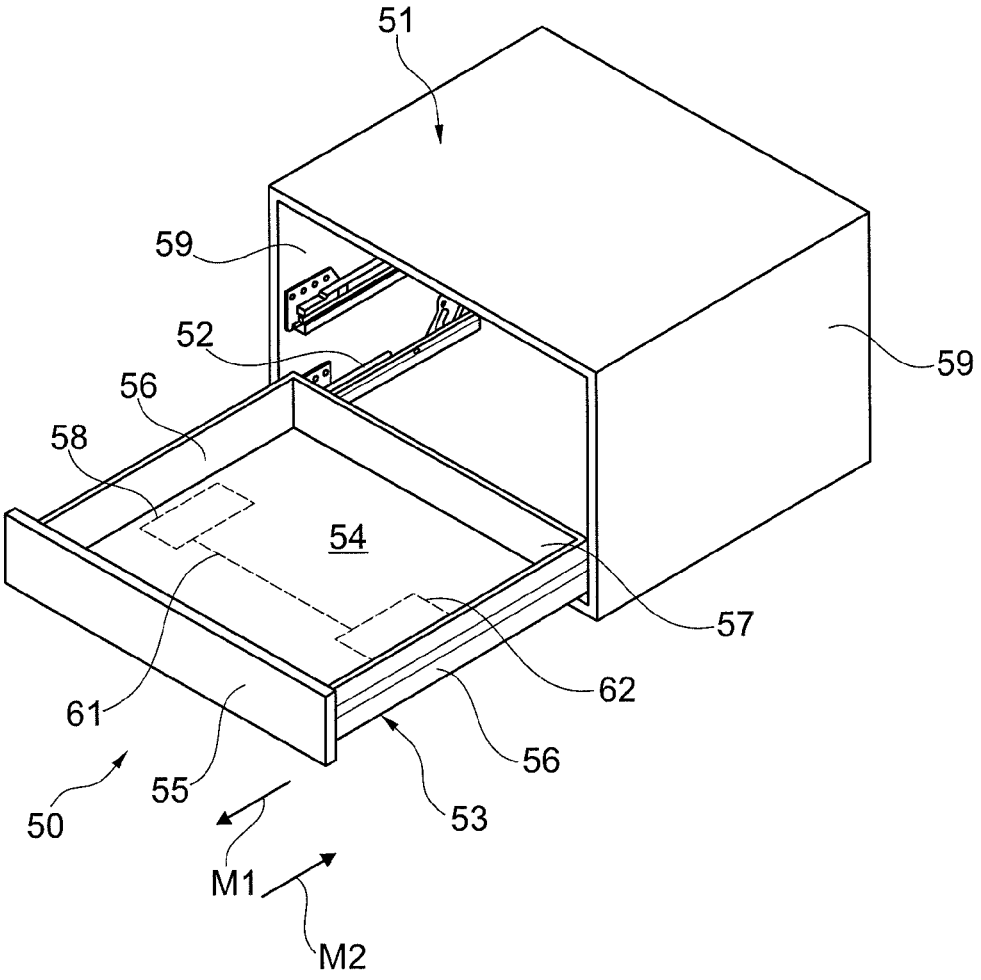
FIG. 1 shows an item of furniture according to the present invention in a perspective view from obliquely above, having a drawer in a completely opened state on a basic furniture structure.

An item of furniture 50 according to the present invention, having a box-shaped basic furniture structure 51 and a drawer 53 which by way of guide means 52 is movably guided, is illustrated in FIG. 1. The drawer 53 comprises a drawer base 54, a drawer front 55, two mutually opposite side walls 56, and a rear drawer wall 57. Two guide means 52 with identical action for guiding the drawer 53 are present in each case between each side wall 56 of the drawer 53 and an associated basic-structure side wall 59. A device 58 according to the present invention (illustrated with dashed lines), for moving or ejecting, respectively, the furniture part which is configured as a drawer 53 in the opening direction M1 is disposed on a lower side of the drawer base 54.

Figure 2:
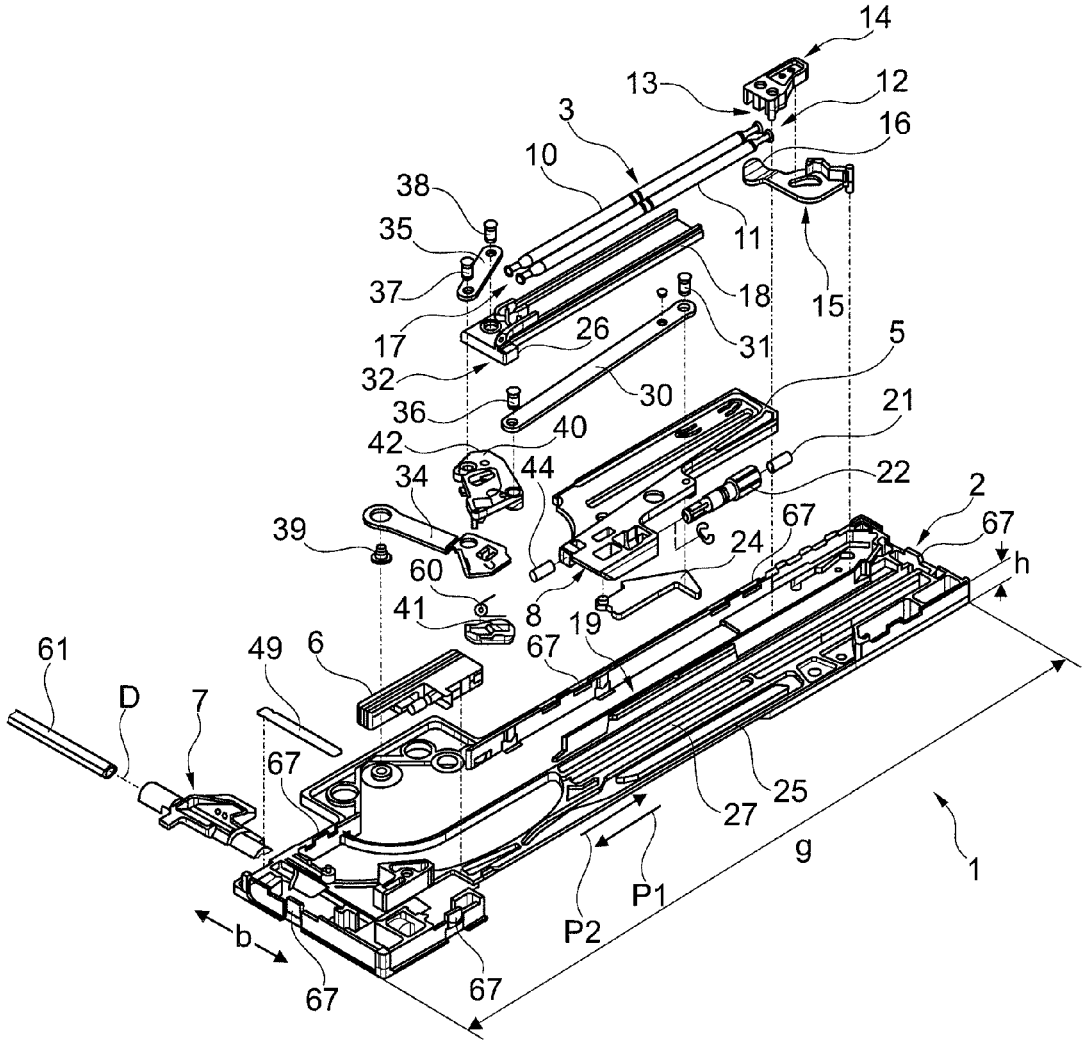
FIG. 2 shows a device according to the present invention, without a cover component, in a exploded illustration.

FIG. 2 shows the exploded illustration of the device 58 which is configured as an ejector unit 1 for the drawer 53.

The ejector unit 1 serves for the force-assisted ejection of the drawer 53 across a first part-distance of the opening movement of the drawer 53 in relation to the basic furniture structure 51, from a closed position in the opening direction M1 of the drawer 53.

The drawer 53 by way of the guide means 52, for example, two identical part pullouts or full pullouts, is mounted on the basic furniture structure 51 so as to be displaceable in the directions M1 and M2. Alternatively, the ejector unit 1 may be disposed on the basic furniture structure 51 or on the guide means 52 of the item of furniture 50.

The ejector unit 1 comprises inter alia a base plate 2, a force accumulator 3, a coupling installation 4, an ejector 5, an activation element which is configured as an activator 6, and a locking member 7.

Figure 9:
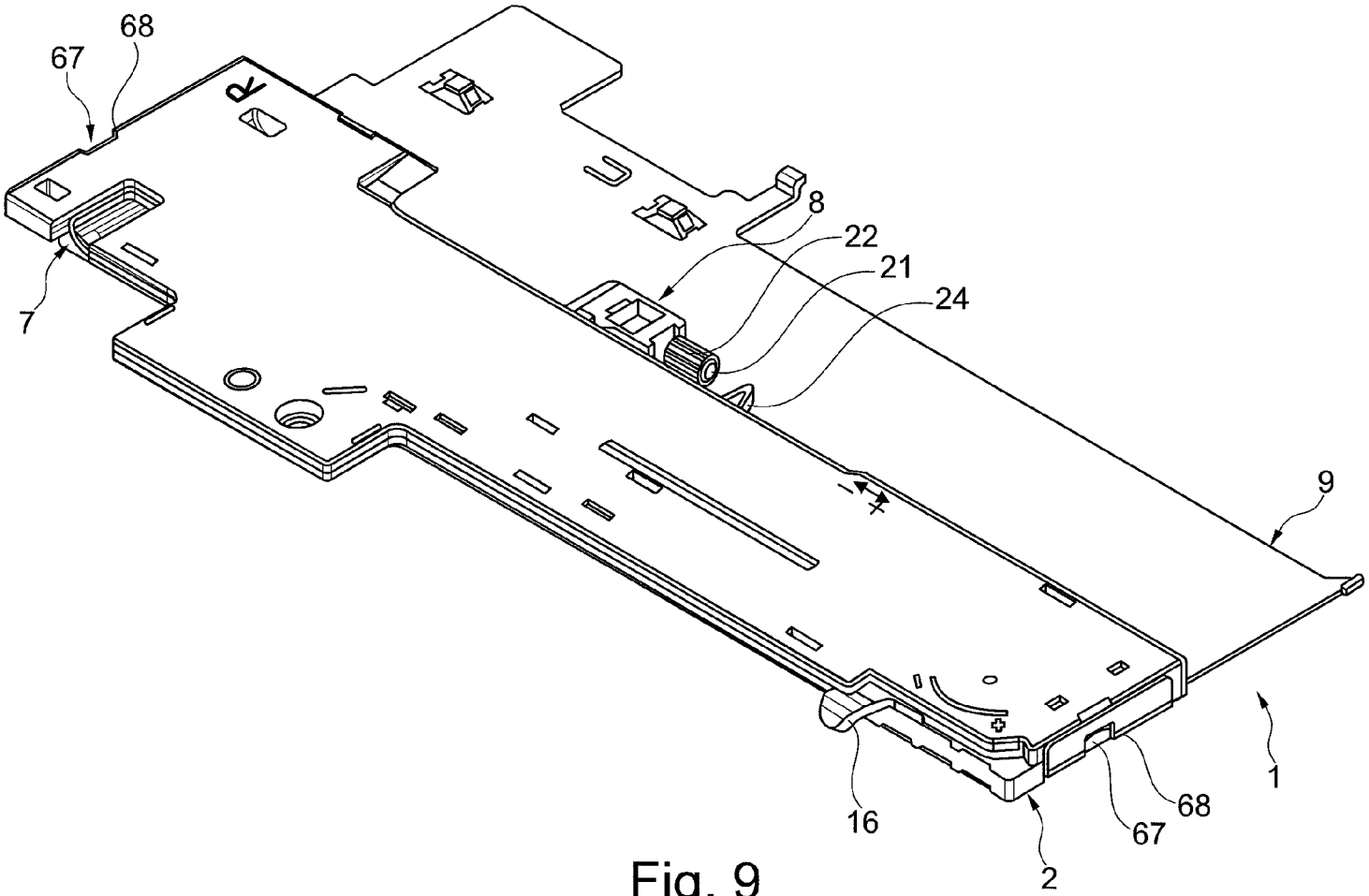
FIG. 9 shows the device according to FIG. 5, having a cover component, in a perspective view from obliquely below toward a second main side of the device.

A housing of the ejector unit 1 comprises the base plate 2 and a cover component 9 which is visible in FIG. 9. The ejector unit 1 may be disposed on the lower side of the drawer base 54 and/or on the guide means 52 by way of the housing or by way of the cover component 9 and/or the base plate 2, respectively.

Retaining portions, guide contours, stop members, and/or receptacle portions for linking the individual components of the ejector unit 1 are configured on the base plate 2. The base plate 2 is designed substantially as a rectangular, elongate or strip-shaped component, having a comparatively minor height h of approx. 5 to 15 millimeters, for example. The base plate 2 furthermore has a width b of approx. 4 to 10 centimeters, and a length g.

According to the exemplary embodiment shown, the force accumulator 3 comprises two identical coil springs 10, 11 which configure a spring pack and which are disposed in parallel. At a first end 12 of the force accumulator 3, the coil springs 10, 11 are disposed on an adjustable fixed mounting 13. The fixed mounting 13 comprises a movable mounting part 14 on which the coil springs 10, 11 are received in a releasable yet fixed manner, and a set part 15 having an operating portion 16 by way of which a user may adjust from the outside a position of the end 12 of the force accumulator 3 in a modifiable and positionally fixed manner. On account thereof, an effect of force of the force accumulator 3 on a drawer 53 may advantageously be pre-adjusted in the case of the opening procedure of the drawer 53.

The associated ends of the coil springs 10, 11 are fastened to a slide-type motion element 18 at a second end 17 of the force accumulator 3. The slide-type motion element 18 by way of an associated guide contour 19 is linearly guided on the base plate 2 so as to be movable in a movement direction P1 and in an opposite movement direction P2.

The movement directions P1 and P2 of the motion element 18 (cf. FIGS. 2 and 3) run parallel with the opening direction M1 of the drawer 53 and with a closing direction M2 which is counter thereto.

If and when the ejector unit 1 is disposed in a positionally fixed manner on the basic furniture structure 51 and/or on a stationary part of the guide means 52, the opening direction of the drawer 53 corresponds to the direction P1, and the closing direction of the drawer 53 corresponds to the direction P2.

Herebelow, an assembled state of the ejector unit 1 on the drawer base 54 is assumed.

Figure 3:
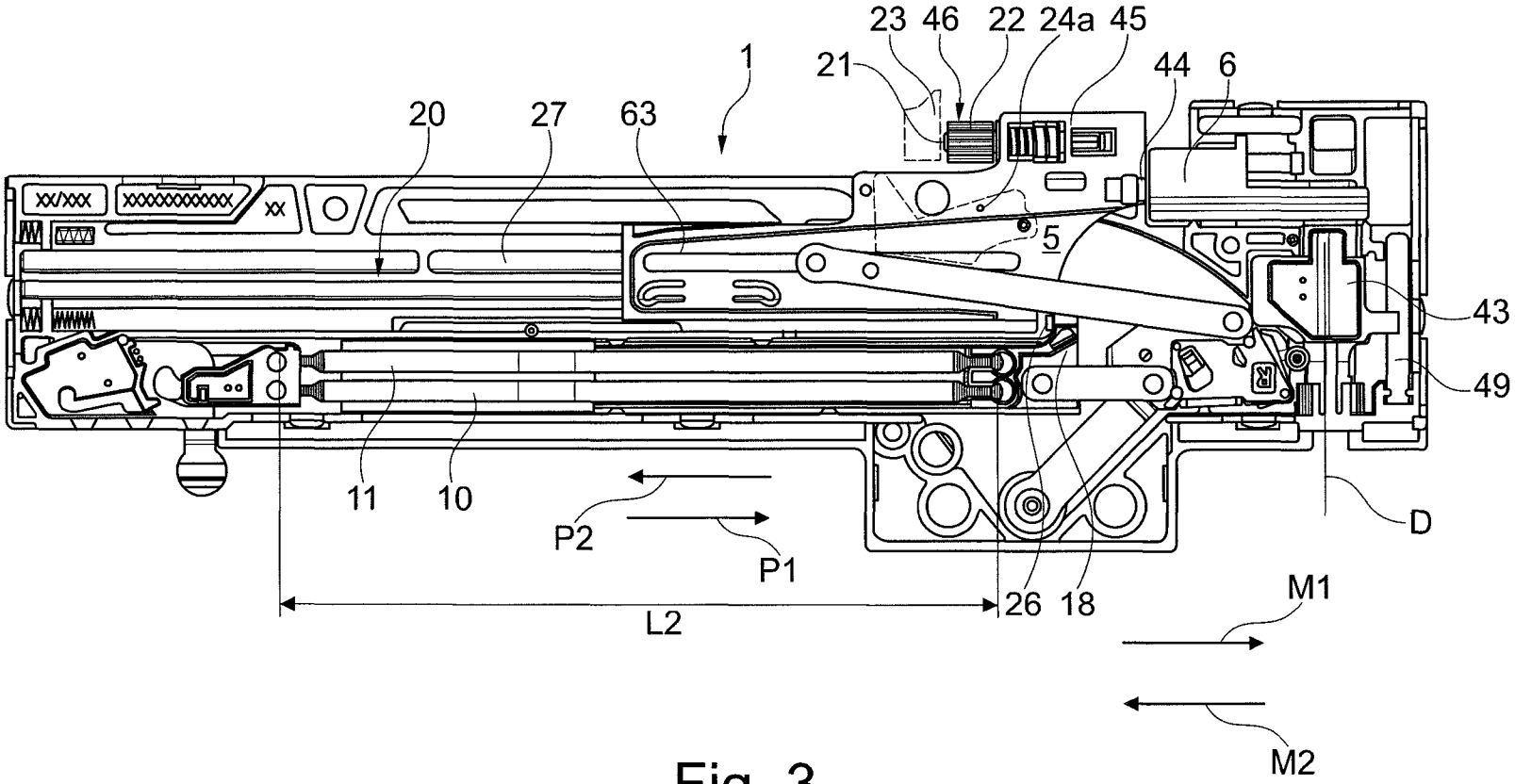
FIGS. 3 to 8 show the device according to FIG. 2, in an assembled state, in a plan view of a first main side, in various operational states.
Figure 7:
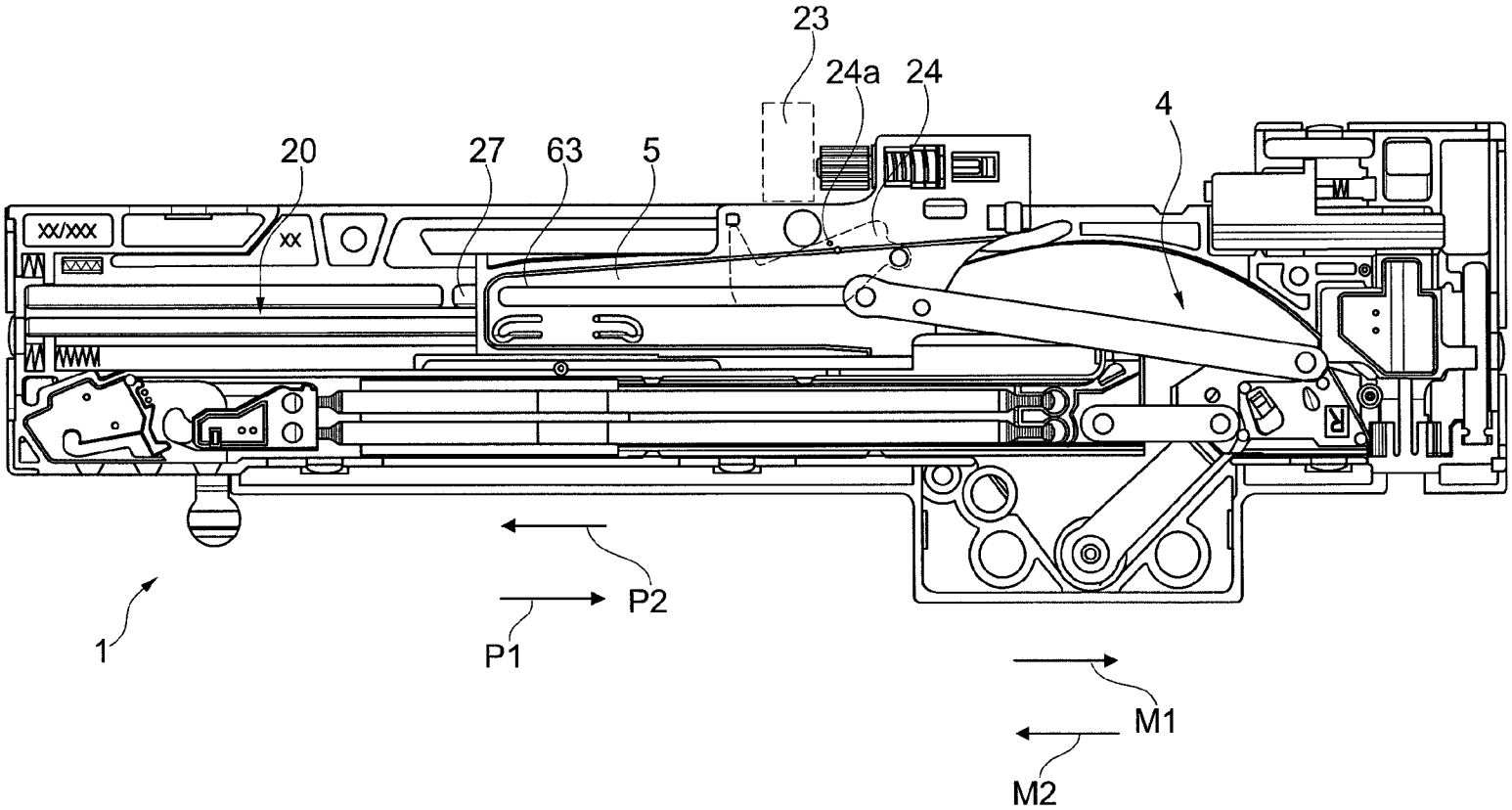
Figure 8:
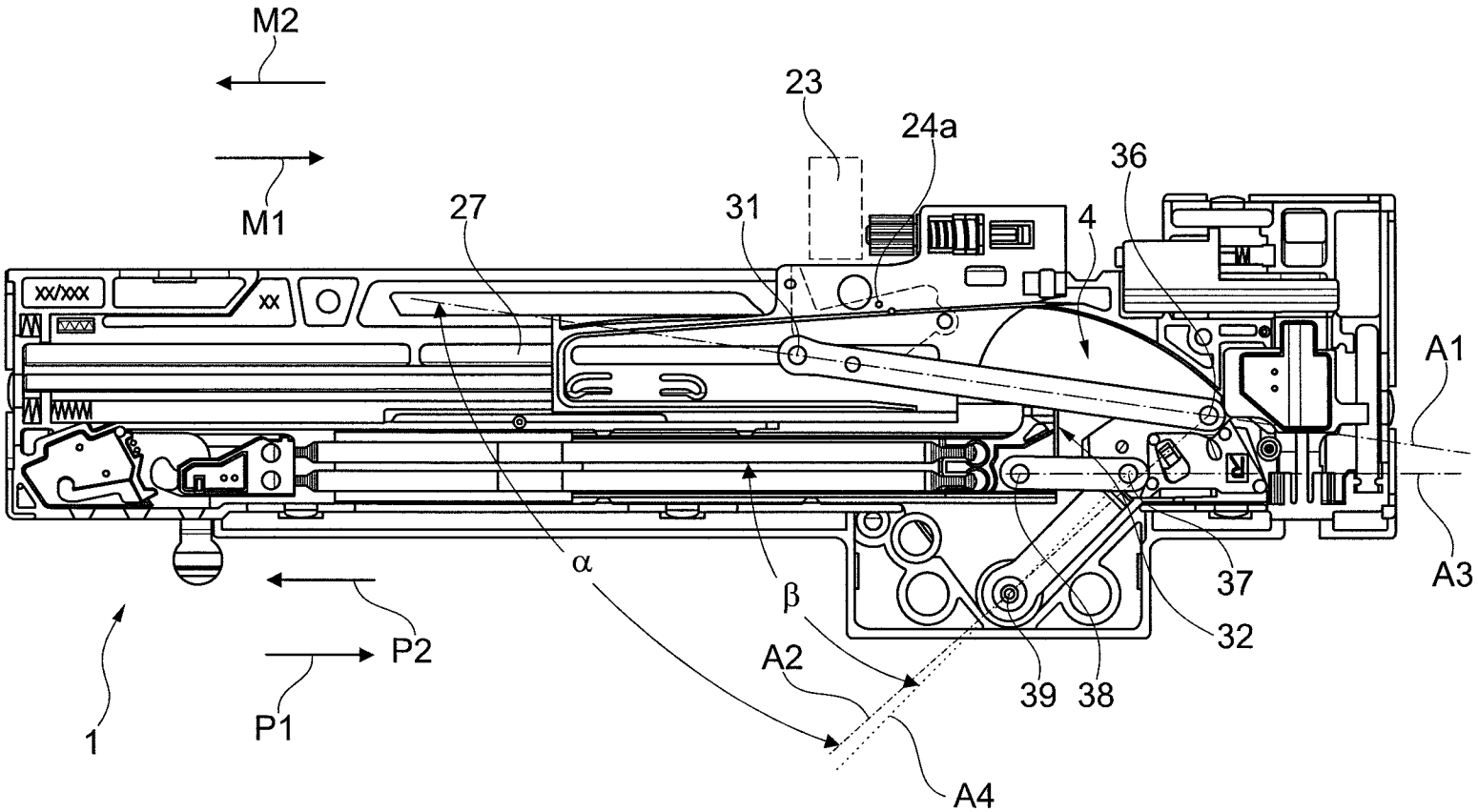

FIGS. 3, 7 and 8 show the ejector unit 1 in a tensioned state of the force accumulator 3, in which the coil springs 10, 11 are elongated or are tensioned so as to be under a tensile load, respectively; herein, the motion element 18 in relation to a retracted position in the direction P2 is offset on the base plate 2 in the direction P1 and is retained in a tensioned position.

Figure 5:
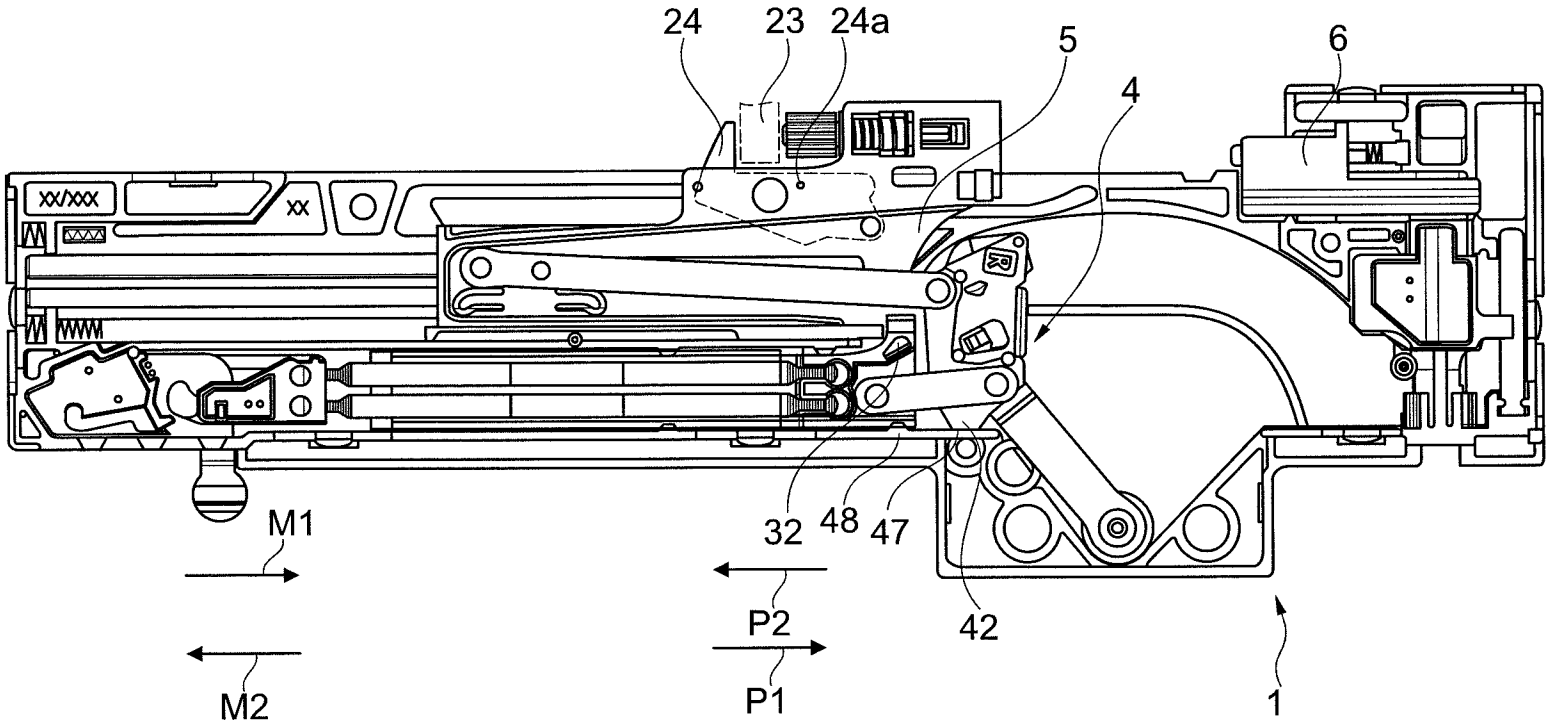
Figure 6:
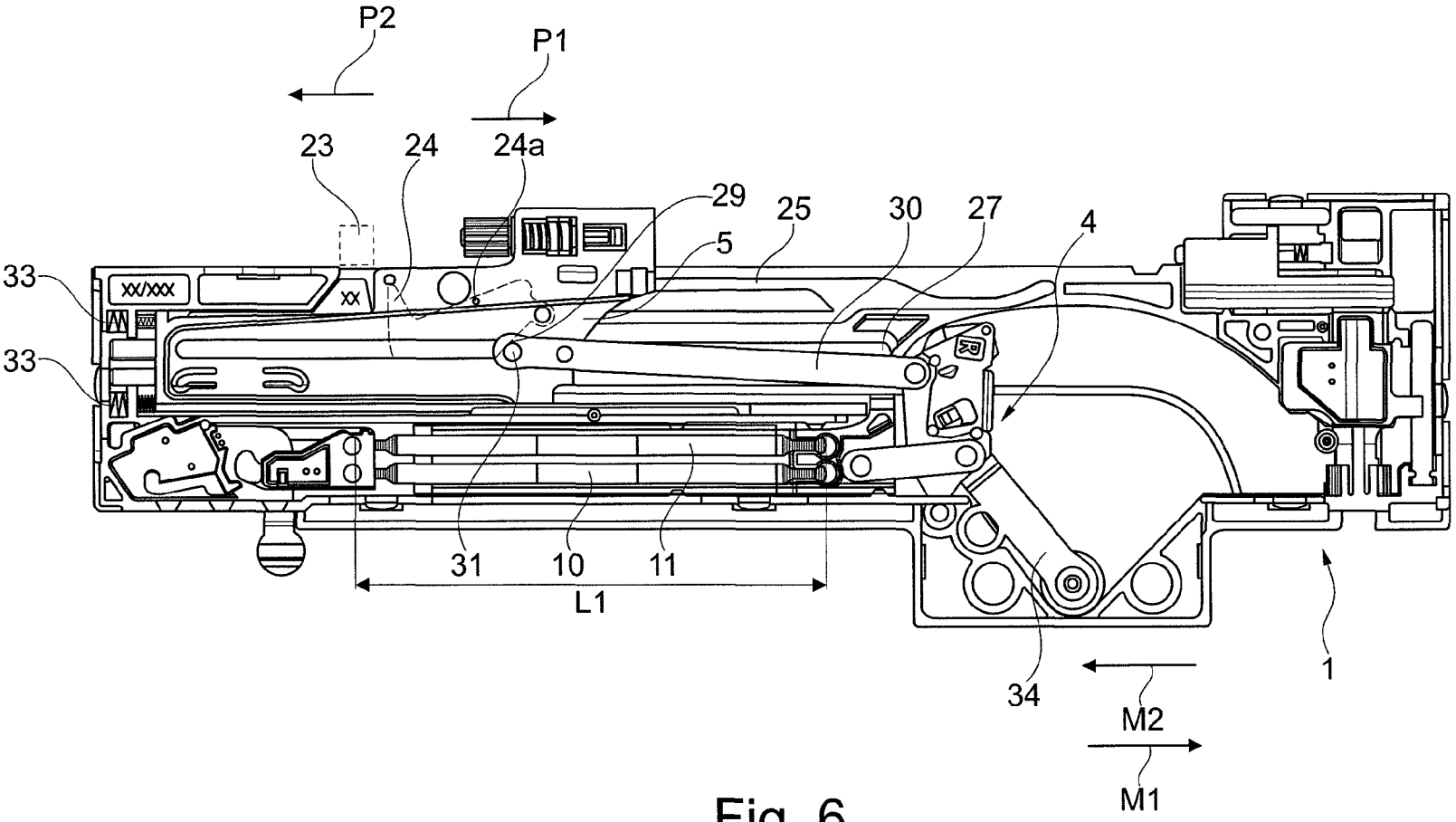

FIGS. 5 and 6 show the ejector unit 1 in a discharged basic state of the force accumulator 3, in which the coil springs 10, 11 are furthermore tensioned under a tensile load but to a lesser degree, having a length L1.

In the tensioned state of the force accumulator 3 the coil springs 10, 11 have a length L2 which is greater than L1.

A retaining element 32 having the stop element 26 is present on the motion element 18.

By way of the coupling installation 4, the force accumulator 3 or the motion element 18, respectively, is operationally connected to the ejector 5, preferably exclusively in the case of the closing procedure of the drawer 53. In particular, the ejector 5 is movable to and fro exclusively in a linear manner, or so as to be parallel with the movement direction of the motion element 18, respectively, in the directions P1 and P2. To this end, a linear guide 20 which is adapted to guide portions, for example, on one side of the ejector 5 is configured on the base plate 2.

Figure 4:
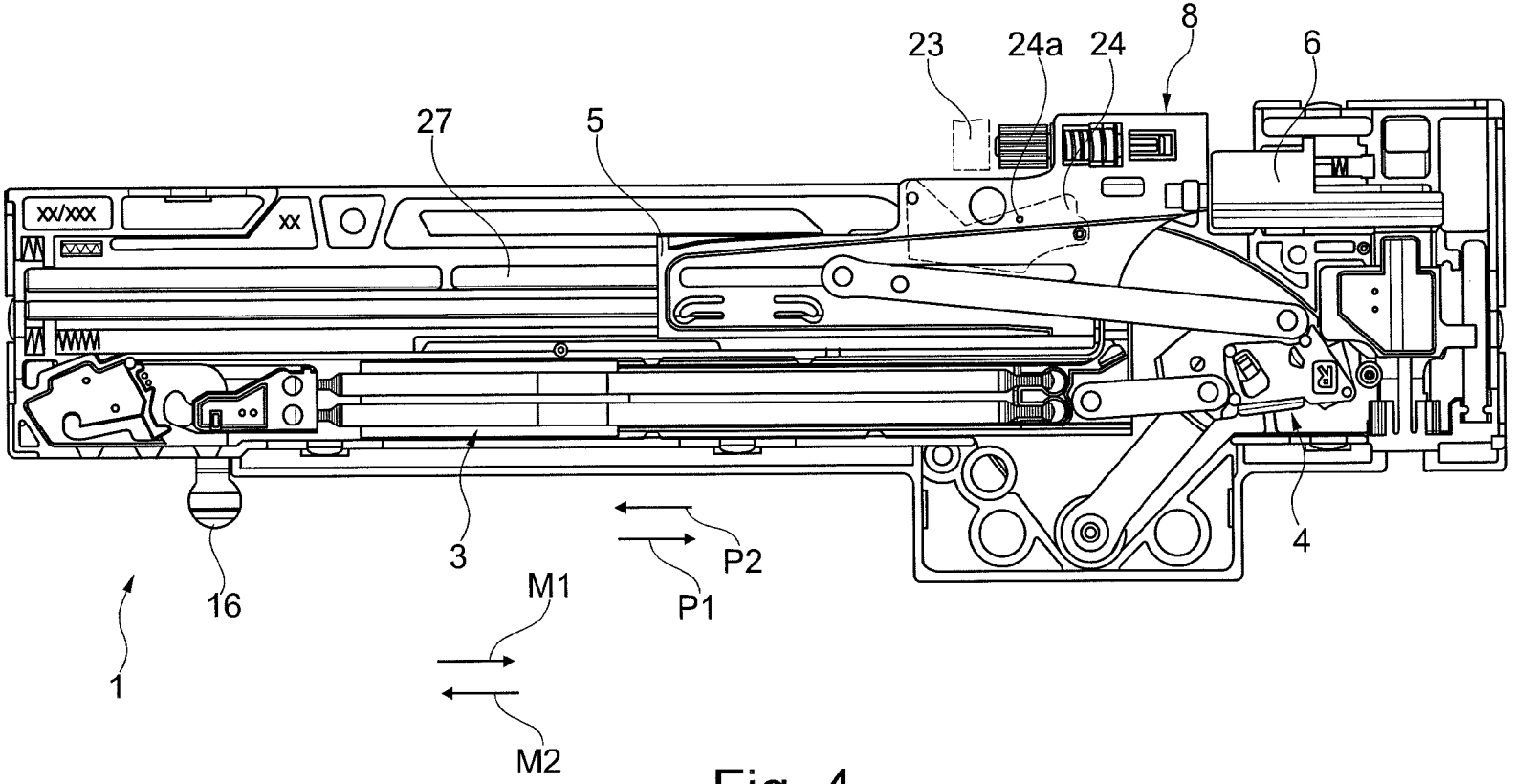

An opening procedure of the drawer 53, caused by the ejector unit 1, takes place exclusively by way of a direct operational connection of the force accumulator 3 to the ejector 5, by way of the motion element 18 which moves in the direction P2. To this end, a stop element 26 which is advantageously designed so as to be elastic and thus prevents or at least dampens any sound which is disturbing to a user when the motion element 18 impacts the ejector 5 in the opening procedure of the drawer 53 is configured on the motion element 18 (FIGS. 3, 4 and 5).

A front-gap adjustment assembly 8 which is configured on the ejector 5 comprises a housing 45 and a set screw 22 having a contact portion 21. The set screw 22 has an external thread which interacts with an internal thread on the housing 45. Depending on the rotation direction, a position of the contact portion 21 of the set screw 22 is adjustable in the direction P1 or P2 by manual rotation of an operating portion 46 of the set screw 22 by a user. In particular, the set screw 22 is configured so as to be self-locking in relation to the housing 45. A measure of a front gap between the drawer front 55 of the drawer 53, which is closed on the basic furniture structure 51, and end sides of the basic furniture structure 51 is capable of being predefined by way of the predefined position of the set screw 22.

The contact portion 21 of the set screw 22 in the tensioned or charged state, respectively, of the force accumulator 3 bears on an entrainment element 23 which in respective operational states forms a stop for the contact portion 21. The entrainment element 23 which in FIGS. 3 to 8 is merely indicated by dashed lines may be present on a fixed rail of the guide means 52, for example, or be attached to the basic furniture structure 51 when the ejector unit 1 is disposed on the drawer 53.

However, if and when the ejector unit 1 is disposed on the basic furniture structure 51 or on a positionally fixed part of the guide means 52 of the item of furniture 50, the entrainment element 23 may be present on the drawer 53 and thus be movable in relation to the basic furniture structure 51.

If and when, proceeding from the basic position of the ejector unit 1 according to FIG. 3, a locking feature is cancelled on the ejector unit 1, as is shown in FIG. 4 and will be explained in more detail below, the tensioned or charged force accumulator 3, respectively, pulls the motion element 18 in the direction P2, the latter by way of the stop element 26 urging or sliding, respectively, the ejector 5 in relation to the base plate 2 in the direction P2.

As soon as the ejector 5 on the base plate 2 moves in the direction P2, a latch component 24 of the ejector unit 1, which is pivotably mounted on the ejector 5, is put from an inwardly pivoted position according to FIG. 4, in which the latch component 24 in relation to an external periphery of the base plate 2 is completely retracted, to an outwardly pivoted position in which the latch component 24 by way of a cam partially projects beyond the external periphery of the base plate 2 (FIG. 5), this being implemented by way of a loop-shaped closed guide track 25 in the base plate 2 and by way of a guide pin 24*a*, engaging in the guide track 25, on the latch component 24.

In order for the latch component 24 to be illustrated, the outline thereof which is obscured by other components, in particular, by the ejector 5, in FIGS. 3 to 8 is indicated with dashed lines.

In the basic state which is illustrated in FIG. 5, the force accumulator 3 is located in a terminal position of the discharged state, wherein the force accumulator 3 is unable to move the ejector 5 any farther in the direction P2.

By virtue of the kinetic energy of the drawer 53, caused by the preceding ejection movement and/or by manually moving the drawer 53 farther in the opening direction M1 by a user, the ejector 5 is subsequently displaced in relation to the base plate 2 in the direction P2. This is possible because the latch component 24 which has been outwardly pivoted so as to project from the ejector 5 bears on the entrainment element 23, the ejector 5 in the further course of the movement of the drawer thus reaching the terminal position thereof which is displaced to a maximum in the direction P2 on the base plate 2. By reaching the terminal position on the ejector 5, the latch component 24 is again completely pivoted inward, this being predefined by the interaction between the guide track 25 and the guide pin 24*a* on the latch component 24 being engaged therein.

If and when the drawer 53 following a discharging procedure of the force accumulator 3 is moved farther in the opening direction M1, the ejector unit 1 separates from the entrainment element 23, cancelling contact between the entrainment element 23 and the contact portion 21 of the set screw 22 (FIG. 6).

From the terminal position described above, which the ejector assumes only briefly, the ejector 5 by spring elements 33 on the base plate 2 is urged by a few millimeters in the direction P1, for example. In relation to the coil springs 10, 11 of the force accumulator 3, the spring elements 33 have a comparatively minor force. By way of the movement of the ejector 5 in the direction P1 by way of the force of the spring elements 33, a bearing portion 29 of the latch component 24 in a standby position of the ejector 5 is put in direct clearance-free contact with a mounting pin 31 of a tension lever 30 of the coupling installation 4 (FIG. 6). The mounting pin 31 is disposed on a first end of the tension lever 30 and may move freely along a, for example, linear, guide track 27 and/or a linear guide 63 which is configured on the ejector 5 for so long, and, in particular, within an opening procedure of the drawer 53, until the latch component 24 holds the mounting pin 31 and/or the tension lever 30 in direct, clearance-free contact with the ejector 5.

The standby position of the ejector 5 which is shown in FIG. 6 at the same time is a starting position of the ejector 5 for a charging procedure of the force accumulator 3 by way of the coupling installation 4.

Besides the tension lever 30, the coupling installation 4 comprises a guide lever 34 and a connection element 35. By way of a mounting pin 36, the tension lever 30 on a second end is articulated on the guide lever 34. The connection element 35, on a second end, by way of a mounting pin 37 which is spaced apart from the mounting pin 36, is likewise articulated on the guide lever 34, and on the first end thereof, the connection element 35 by way of a further mounting pin 38 is articulated on the motion element 18. The guide lever 34 at a first end by way of a mounting pin 39 is disposed so as to be movable, in particular, pivotable, on the base plate 2. The mounting pin 39 is preferably received both on the base plate 2 as well as on the cover component 9.

A longitudinal axis A3 of the tension lever 30, which runs through the mounting pins 31, 36 of the tension lever 30, in relation to a first longitudinal axis A2 of the guide lever 34, which runs through the mounting pins 36, 39, has an angle $\alpha$.

A longitudinal axis A3 of the connection element 35, which runs through the mounting pins 37, 38 of the connection element 35, in relation to a second longitudinal axis A4 of the guide lever 34, which runs through the mounting pins 37, 39, has an angle $\beta$.

The guide lever 34 of the coupling installation 4, on a second end, comprises a lever attachment 40. A locking element 41 and a stop element 42 are configured on the lever attachment 40.

The terminal position of the discharged state of the force accumulator 3 (FIG. 5) is predefined by a stop of the stop element 42 of the guide lever 34 on a wall portion 47 on a step-type wall 48 of the base plate 2. The wall portion 47 is formed from an annular portion of a damping element, for example. If and when the stop element 42 of the guide lever 34 following a discharging procedure of the force accumulator 3 bears on the wall portion 47, by virtue of a remaining bias of the coil springs 10, 11 a tensile force in the direction P2 is transmitted from the motion element 18 by way of the connection element 35 to the guide lever 34. By virtue of the rigid embodiment of the coupling installation 4, or by virtue of the impact of the stop element 42 on the wall portion 47, respectively, the motion element 18 is prevented from moving farther in the direction P2, wherein the force accumulator 3 by way of the motion element 18 is held free of clearance in the terminal position of the discharged state.

In particular, the stop element 42 and/or the wall portion 47 may be designed so as to be elastic or damping, respectively, thus reducing or preventing an impact noise.

When tensioning the force accumulator 3, the guide lever 34 by virtue of the design thereof may transmit a force from the tension lever 30 to the connection element 35 at a geared up ratio.

The gear ratio is formed, on the one hand, by the ratio of the spacing of the mounting pins 39 and 36 in relation to the spacing of the mounting pins 39 and 37 on the guide lever 34 and, on the other hand, by the combined mutual circular and linear movement of the tension lever 30 and/or of the connection element 35 during the charging procedure of the force accumulator 4.

The elements of the coupling installation 4, by virtue of the arrangement of the former on the ejector unit 1, may move as follows:

The mounting pin 31 and thus the first end of the tension lever 30, by virtue of the mounting thereof in the guide track 27, may move exclusively parallel with a movement direction of the ejector 5, in particular, parallel with a movement direction of the movable furniture part 53.

The mounting pin 38 and thus the first end of the connection element 35, by virtue of the mounting thereof on the slide-type motion element 18 and thus advantageously in the guide contour 19, may move exclusively parallel with a movement direction of the motion element 18 or of the ejector 5, respectively, in particular, parallel with the movement direction of the movable furniture part 53.

The mounting pin 36 and thus the second end of the tension lever 30, by virtue of the mounting thereof at the second end of the guide lever 34, may move exclusively in a circular path about a rotation center of the mounting pin 39 of the guide lever 34.

The mounting pin 37 of the connection element 35 and thus the second end of the connection element 35, by virtue of the mounting thereof in a central region of the guide lever 34, may move exclusively in a circular path about a rotation center of the mounting pin 39 of the guide lever 34.

By virtue of the above-mentioned design, the coupling installation 4 may transmit at a geared up ratio a force for tensioning the force accumulator 3 from the ejector 5 by way of the tension lever 30 and of the guide lever 34 to the connection element 35 and thus to the force accumulator 3, and, in particular, transmit the force which is exerted by the ejector 5 in a geared down ratio to the force accumulator 3. This means that a user when charging the force accumulator 3 has to apply less force to the ejector 5 than the user would have to apply when wishing to charge the force accumulator 3 without gearing down, or when directly pulling the end 17 of the force accumulator 3 in the direction P1, respectively.

The beginning and the end of the charging procedure of the force accumulator 3 or of the coil springs 10, 11, respectively, are visualized in FIGS. 6 and 7.

Tensioning of the force accumulator 3 is performed by a movement of the drawer 53 in the case of closing, or on a part-distance of the closing movement of the drawer 53. The starting position of the ejector unit 1, in which the latter is prepared for tensioning of the force accumulator 3 and expects a closing procedure of the drawer, is shown in FIG. 6.

If and when the drawer 53 is closed, for example, from the outside by a user, the ejector unit 1 moves in the direction M2 toward the entrainment element 23. The charging procedure of the force accumulator 3 begins as the contact portion 21 of the set screw 22 of the ejector 5 impacts on the entrainment element 23. The ejector 5, by impacting on the entrainment element 23, is moved in the direction P1, for example, by virtue of the inertia of the drawer 53 in relation to the base plate 2.

By way of the coupling of the ejector 5 to the force accumulator 3 by way of the coupling installation 4, the motion element 18 of the force accumulator 3 is likewise displaced in relation to the base plate 2 in the direction P1, and the second end 17 of the coil springs 10, 11 is displaced in the direction P1, the coil springs 10, 11 thus being elongated.

At the end of the tensioning procedure of the force accumulator 3, the ejector 5 is located in a terminal charging position, as is shown in FIG. 7. In a tensioned state of the force accumulator 3, the ejector unit 1 is located in a locked state.

In the locked state, a locking state is determined by the locking element 41 of the coupling installation 4 and by the locking member 7 which is configured as a flap, wherein a discharging movement of the coupling installation 4 is blocked by the locking member 7.

Tensioning of the force accumulator 3 is fully completed prior to an automatic retracting feature for the force-assisted retraction of the drawer 53 to the fully closed position on the basic furniture structure 51 becoming effective, for example. The automatic retracting feature is not part of the ejector unit 1, and is integrated in the guide means 52 or in the part pullouts or full pullouts, respectively, for example.

After the force accumulator 3 has been tensioned, the ejector 5 by virtue of bearing on the entrainment element 23 is moved farther in relation to the base plate 2 by way of the further closing movement of the drawer 53. Herein, the operational connection between the latch component 24 of the ejector 5 and the mounting pin 31 of the tension lever 30 is cancelled. This is performed by an interaction between the guide track 25 and the guide pin 24*a* on the latch component 24, wherein the latch component 24 by the guiding of the guide pin 24*a* in the guide track 25 is pivoted away from the mounting pin 31 (FIG. 8). In this state, the ejector 5 is uncoupled from the coupling installation 4 and is displaceable so far in the direction P1, in particular, by an automatic retracting feature, until the drawer 53 is fully closed on the basic furniture structure 51, and the ejector 5 bears on the activator 6 in the basic position according to FIG. 3.

In the basic position of the ejector unit 1 according to FIG. 3, it is possible for a user to pull the drawer 53 in the opening direction M1 without an ejector function or without first manually cancelling the locking state, respectively. Herein, the force accumulator 3 of the ejector unit 1 remains non-actuated or charged, respectively.

In order for the drawer 53 by way of the ejector unit 1 to be expelled from the position in which the drawer 53 is completely retracted or closed, respectively, on the basic furniture structure 51, a user has to act on the drawer while pushing from the outside in the direction M2. To this end, the ejector unit 1 has a so-called touch-latch function which knows a locked state which is unlockable in that the retracted drawer 53 which is closed on the basic furniture structure 51 is moved in the closing direction M2. This closing movement, or inward pushing of the drawer 53 in the direction M2, respectively, is performed until a stop position corresponding to a front gap which in the closed state of the drawer 53, is predefined, in particular, by way of a spacing between an internal side of the drawer front 55 and a forward end side or the side walls 56 of the basic furniture structure 51, respectively, is reached. The front gap is typically a few millimeters, for example, approx. 1 to 10 millimeters.

Accordingly, unlocking of the ejector unit 1 is adapted in such a manner that a closing movement of the drawer 53 in the direction M2 of a few millimeters, or at maximum by the value of the front gap, respectively, is sufficient for unlocking and thus the force-assisted ejection of the drawer 53 to be reliably predefined.

Proceeding from the basic position according to FIG. 3, the ejector unit 1 together with the drawer 53 is moved in the direction M2. Since the stop screw 22 bears on the entrainment element 23, the ejector 5 is moved in relation to the base plate 2 in the direction P1, a contact portion 44 on the ejector 5 thus pressing against the activator 6, accordingly pushing the latter in the direction P1. The activator 6 is present on the base plate 2 so as to be linearly displaceable in a limited manner, typically by a few millimeters or by less than the dimension of the front gap, respectively, in the directions P1 and P2.

The activator 6 is preferably directly coupled to the locking member 7 which is designed as a flap 43 in such a manner that the linear activation movement of the activator 6 in the direction P1 sets the flap 43 in rotary motion about a pivot axis D. The flap 43 by the rotating movement is released from a locked position into which the flap 43 is urged by a spring member which is configured as a leaf spring 49. In the locked state of the ejector unit 1, the flap 43 which is located in the locking position blocks the guide lever 34 or the lever attachment 40, respectively, in such a manner that the force accumulator 3 remains in the charged state thereof.

Blocking of the guide lever 34 is cancelled by the rotating movement of the flap 43. The locking element 41 on the lever attachment 40, which is biased by a leg spring 60, hereby preferably pivots out.

The locking element 41, which projects from the lever attachment 40, moves conjointly with the pivoting procedure of the guide lever 34 below the flap 43, past the latter, and continues without interruption the rotating movement of the flap 43, initiated by the activator 6, about the pivot axis D. On account thereof, a rotation angle of the flap 43 out of the locking position is advantageously enlarged. The ejector unit 1 is reliably unlocked by the movement of the lever attachment 40 below and past the flap 43 and continued by the outwardly pivoting locking element 41. To this end, an advantageously comparatively very minor linear activation movement of the activator 6 in the direction P1 is required. Subsequently, the flap 43 by the leaf spring 49 is urged back into the locking position of the former.

The locking element 41 which is present so as to be outwardly pivoted on the lever attachment 40 is again brought to bear on a front edge of the flap 43 when the force accumulator 3 is tensioned. Herein, the locking element 41 yields counter to the spring force of the leg spring 60, such that the locking element 41 is retracted so far on a periphery of the lever attachment 40 that the guide lever 34 by way of the lever attachment 40 can pivot past the flap 43.

Behind the flap 43, the locking element 41 is outwardly pivoted again by the spring force of the leg spring 60. Following the tensioning procedure, the guide lever 34 by way of the projecting locking element 41 is pushed against the flap 43 which is held by the leaf spring 49 so as to lock, the force accumulator 3 thus being in the locked state.

The rotating movement of the flap 43 of the ejector unit 1, or of the device 58, respectively, is transmitted by a synchronizer bar 61 which is disposed so as to be rotationally fixed on the flap 43 to a second device 62 which is advantageously of identical action and which is disposed on the drawer 53.

The synchronizer bar 61 advantageously connects the locking member 7 to a second locking member which is present on the second device 62. The two locking members are thus directly and/or synchronously coupled in terms of motion. This represents a synchronizing principle which is contrarian to a connection between activator elements of two ejector units on one furniture part.

Figure 10:
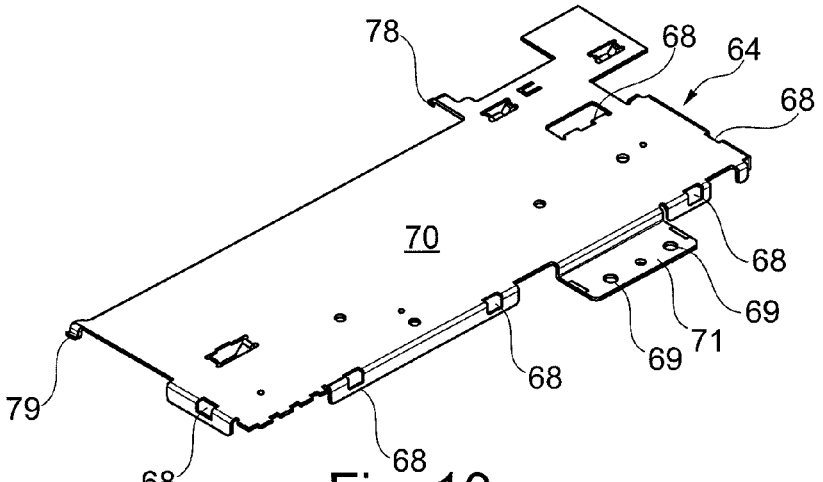
FIG. 10 shows the cover component according to FIG. 9, in a view from below.

FIG. 10 in a perspective manner in a view from below shows the cover component 9 of FIG. 9, which by plug-fitting is connectable to the base plate 2. The cover component 9 is designed as a sheet-metal fastening panel 64 having a sheet-metal area portion 70 and peripheral shapings which are configured in a predefined manner.

Figure 11:
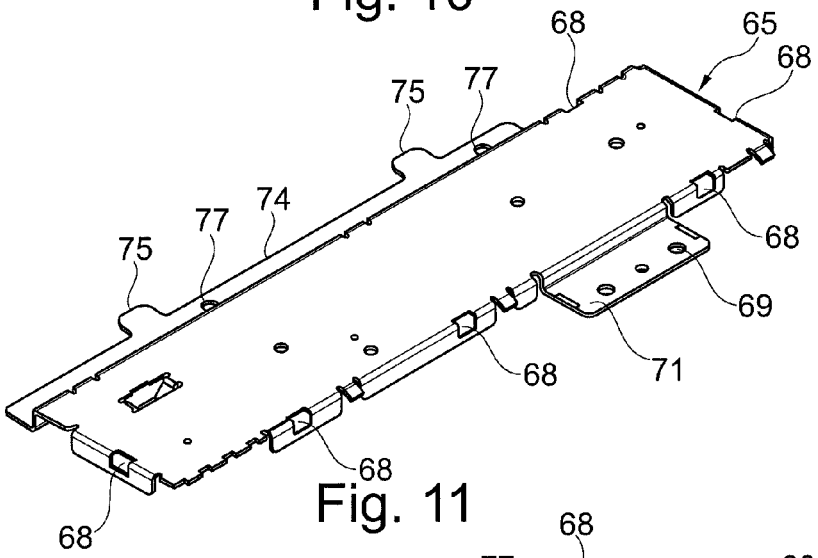
FIGS. 11 and 12 each show a perspective view from below of alternative cover components.
Figure 12:
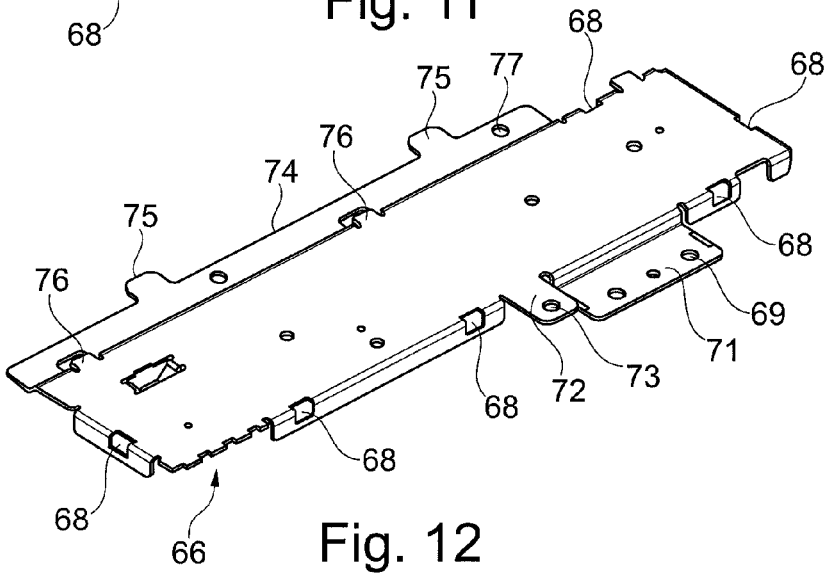

FIGS. 11 and 12 show further cover components 9 which match the identical base plate 2 of the ejector unit 1 and which are designed in an alternative manner to the sheet-metal fastening panel 64 as a sheet-metal fastening panel 65 and a sheet-metal fastening panel 66.

The sheet-metal fastening panel 64 serves as a part-housing, or for covering the ejector unit 1 on a main side of the ejector unit 1, respectively. With the aid of the sheet-metal fastening panel 64, the ejector unit 1 on the guide means 52 and/or the drawer 53. Depending on the attachment point of the ejector unit 1 on the item of furniture 50, and, in particular, depending on the guide means 52 present, one of the sheet-metal fastening panels 64, 65, or 66, which is in each case configured so as to be adapted in a matching manner is used.

Each of the sheet-metal fastening panels 64, 65, and 66 has connection means which comprise portions which are designed so as to be prepared for plug-fitting on or onto the base plate 2, respectively, and which differ from one sheet-metal fastening panel to another, or which each are dissimilar to another, respectively. Preferably, the portions are designed in peripheral regions of the respective sheet-metal fastening panel 64, 65, or 66. Accordingly, a plurality of prepared portions such as, for example, six spring lugs 67 for connecting to a cover component 9, or for interacting with associated matching connection means on the cover component 9, are designed on the base plate 2. The spring lugs 67 which here are bent back in a hook shape, for example, may compress somewhat elastically when the cover component 9 is plug-fitted onto the base plate 2. In the case of the completely assembled ejector unit 1, each spring lug 67 is snap-fitted to an associated window-type clearance 68 on the cover component 9, wherein the base plate 2 and the cover component 9 are capable of being latched to a plurality of points so as to correspond to the number of spring lugs 67, the number presently being six.

The sheet-metal fastening panels 64, 65, and 66 each have the clearances 68 on the conforming points. Each of the sheet-metal fastening panels 64, 65, and 66 is thus connectable to the base plate 2 in an identical manner.

Attaching the ejector unit 1 which, as has been described above, is assembled by plug-fitting the base plate 2 and one of the sheet-metal fastening panels 64, 65, and 66, to a furniture part and/or to the guide means 52 is establishable by way of plug-fitting, screw, latching, adhesive, and/or other types of connections.

A common feature of the sheet-metal fastening panels 64, 65, and 66, are screw bores 69 for screw means (not illustrated) to engage therethrough for screw-fitting to the lower side on the drawer base 54, for example.

The screw bores 69 are present on a first longitudinal side of the sheet-metal fastening panels 64, 65, and 66, on a lug 71 which by way of two rectangular bent-back features on the sheet-metal area portion 70 projects laterally in a parallel manner offset in relation to the sheet-metal area portion 70.

A further lug 72 having a screw bore 73 is configured on the sheet-metal fastening panel 66 on the plane of the sheet-metal area portion 70.

For further integration of the ejector unit 1, which is disposed on the lower side on the drawer base 54, on the guide means 52 or on a side frame of the nearest side wall 65, the connection means on the cover component 9, here at the sheet-metal fastening panels 65 and 66, comprise a web 74. The web 74 across the substantial length of the sheet-metal fastening panels 65 and 66 is designed having two mutually spaced apart and laterally projecting tongues 75. The web 74 on that longitudinal side of the sheet-metal fastening panels 65 and 66 that is opposite the lug 71 is present in a manner so as to be offset to and parallel with the sheet-metal area portion 70 by bent-back features. The tongues 75 may engage in a clamping manner, for example, in corresponding matching clearances on the guide means of a basic-structure rail, for example, and/or on the side wall of the drawer 53.

Moreover, two mutually spaced apart and projecting tongues 76 are configured on the sheet-metal fastening panel 66 on the associated longitudinal periphery of the sheet-metal area portion 70.

Furthermore, screw bores 77 are provided in the web 74.

On the sheet-metal fastening panel 64 which has no web 74, the connection means have comparatively narrow hook-type lugs 78 and 79.

The sheet-metal fastening panel 65 is configured for being inserted in a sunken manner into a depressed routed-out feature on the lower side on the drawer base 54. Therefore, the web 74, in a manner corresponding to the depth of the routed-out feature, is further set back in relation to the sheet-metal area portion 70. On account thereof, the tongues 75 on the plane of the lower side of the drawer base are configured for engaging in associated regions.

With the exception of the web 74, the ejector unit 1 is then capable of being completely sunk into the drawer base 54, for example.

The integration of the ejector unit 1 by means of the tongues 75, 76 and of the lugs 78, 79 is preferably performed without tools.

LIST OF REFERENCE SIGNS

1 Ejector unit
2 Base plate
3 Force accumulator
4 Coupling installation
5 Ejector
6 Activator
7 Locking member
8 Front gap adjustment assembly
9 Cover component
10 Coil spring
11 Coil spring
12 End
13 Fixed mounting
14 Mounting part
15 Set part
16 Operating portion
17 End
18 Motion element
19 Guide contour
20 Linear guide
21 Contact portion
22 Set screw
23 Entrainment element
24 Latch component
**24*a*** Guide pin
25 Guide track
26 Stop element
27 Guide track
29 Stop portion

30 Tension lever
31 Mounting pin
32 Retaining member
33 Spring element
34 Guide lever
35 Connection element
36-39 Mounting pin
40 Lever attachment
41 Locking element
42 Stop element
43 Flap
44 Contact portion
45 Housing
46 Operating portion
47 Wall portion
48 Wall
49 Leaf spring
50 Item of furniture
51 Basic furniture structure
52 Guide means
53 Drawer
54 Drawer base
55 Drawer front
56 Side wall
57 Rear drawer wall
58 Device
59 Basic structure side wall
60 Leg spring
61 Synchronizer bar
62 Device
63 Linear guide
64-66 Sheet-metal fastening panel
67 Spring lug
68 Clearance
69 Screw bore
70 Sheet-metal area portion
71, 72 Lug
73 Screw bore
74 Web
75, 76 Tongue
77 Screw bore
78, 79 Lug

The invention claimed is:

1. A device for moving a movable furniture part in an opening direction of the furniture part in relation to a basic furniture structure of an item of furniture, wherein the movable furniture part by way of guide means is capable of being put in the opening direction and in a closing direction which is counter to the opening direction, wherein the device comprises a basic component having an outline contour, a force accumulator on the basic component, such that by way of the device the movable furniture part under the action of the force accumulator is capable of being put in the opening direction of the movable furniture part, a separate cover component configured to match the basic component, the cover component covering the basic component, connection means defined on the cover component, the connection means being configured to integrate the device on one of a counter portion on the item of furniture and the guide means, wherein the cover component includes an outwardly projecting contour including a plurality of contour portions, defined on a peripheral portion thereof, the plurality of outwardly projecting contour portions projecting over the outline contour of the basic component.

2. The device according to claim 1, wherein the cover component has a planar portion which extends across a substantial extent of the cover component.

3. The device according to claim 1, wherein the cover component has a bearing side which is configured for bearing in a planar manner on an attachment face of the item of furniture when the device is fitted to the item of furniture.

4. The device according to claim 1, wherein the cover component is designed for at least almost completely covering a main side of the basic component.

5. The device according to claim 1, wherein the cover component has a peripheral portion which by way of a bent-back feature adjoins a planar portion of the cover component.

6. The device according to claim 1, wherein the basic component includes sides having a selected height, the sides having the selected height being covered by a bent-back peripheral portion of the cover component.

7. The device according to claim 1, wherein the connection means on the cover component are configured in such a manner that integration of the device on the one of the counter portion on the item of furniture and the guide means is establishable without tools.

8. The device according to claim 1, wherein the cover component and the basic component are mutually adapted in such a manner that in the connected state of the cover component and of the basic component a portion of the basic component outwardly projects on one narrow side of the device.

9. The device according to claim 1, wherein the connection means are configured for a releasable connection to the guide means of the movable furniture part.

10. The device according to claim 1, wherein the cover component is configured for attaching the device on a lower side of a drawer.

11. The device according to claim 1, wherein the cover component is configured for integration of the device in a region configured so as to be depressed on the item of furniture.

12. An item of furniture having a basic furniture structure and a movable furniture part which by way of guide means is capable of being put in an opening direction of the furniture part and in a closing direction which is counter to the opening direction relative to the basic furniture structure, wherein a device according to claim 1 is provided.

* * * * *